US006220188B1

(12) United States Patent
Boutrup

(10) Patent No.: US 6,220,188 B1
(45) Date of Patent: Apr. 24, 2001

(54) WINDBOX BURNER

(75) Inventor: Bruno Boutrup, Dragør (DK)

(73) Assignee: Burmeister & Wain Energi A/S, Virum (DK)

( * ) Notice: Subject to any disclaimer, the term of this patent is extended or adjusted under 35 U.S.C. 154(b) by 0 days.

(21) Appl. No.: 09/254,487

(22) PCT Filed: Sep. 9, 1997

(86) PCT No.: PCT/DK97/00374

§ 371 Date: Jan. 12, 2000

§ 102(e) Date: Jan. 12, 2000

(87) PCT Pub. No.: WO98/11384

PCT Pub. Date: Mar. 19, 1998

(30) Foreign Application Priority Data

Sep. 9, 1996 (DK) ..... 0970/96

(51) Int. Cl.[7] ..... F23L 13/00; F23N 3/00

(52) U.S. Cl. ..... 110/163; 110/147; 110/297; 110/314; 110/261

(58) Field of Search ..... 110/297, 314, 110/101 R, 123, 126, 147, 163, 150, 157, 261, 262, 104 B

(56) References Cited

U.S. PATENT DOCUMENTS 598,448 * 2/1898 Summe ..... 122/67
1,213,821 * 1/1917 Bergman ..... 110/104 B
4,147,116 * 4/1979 Graybill ..... 110/263
4,175,756 * 11/1979 Denton et al. ..... 277/189
4,199,949 * 4/1980 Cadeddu ..... 60/589
5,011,400 * 4/1991 Vatsky ..... 431/4
5,738,021 * 4/1998 Vatsky et al. ..... 110/163
5,878,676 * 3/1999 Jochem et al. ..... 110/261

* cited by examiner

*Primary Examiner*—Denise L. Ferensic
*Assistant Examiner*—K. B. Rinehart
(74) *Attorney, Agent, or Firm*—Venable; John P. Shannon

(57) ABSTRACT

The windbox burner has a register casing (2) with ports (3) for inflow of combustion air, secondary air pipe (35) enclosed by the register casing and having inlet ports (36) for secondary air, a ring damper (20) coaxial with the register casing and axially displaceable and having at each end an annular sealing means (21; 26) which in the closed position of the ring damper sealingly abuts a corresponding sealing arrangement (23; 22) at each axial end of the ports (3), thus preventing the combustion air from flowing through the ports (3) to the burner tip. Each of the sealing arrangements (21, 23; 22, 26) is made of a stainless and heat-resistant material, and each pair of the sealing arrangements is constituted by a plane leaf spring (23; 26) the plane of which is substantially perpendicular to the longitudinal axis of the ring damper (20), and a ring (21, 22) with a convex surface on which the leaf spring abuts tangentially in the closed position of the ring damper.

15 Claims, 5 Drawing Sheets

WINDBOX BURNER

The present invention relates to a windbox burner comprising a register casing with ports for inflow of combustion air, a secondary air pipe coaxial with the register casing and enclosed by it and having inlet ports for secondary air, a ring damper substantially coaxial with the register casing and axially displaceable and having at each end an annular sealing means which in the closed position of the ring damper sealingly abuts a corresponding annular sealing means at each axial end of the ports, thus preventing the combustion air from flowing through the ports to the burner tip, in which each pair of mutually abutting sealing means is made of a stainless and heat-resistant material, and in which one sealing means comprises at least one plane leaf spring the plane of which is substantially perpendicular to the longitudinal axis of the ring damper.

In large furnace plants, such as refuse incineration plants or steam boilers, it is common that one or more windboxes for supply of combustion air are provided on the front wall of the boiler. Each windbox comprises several windbox burners, each capable of containing, for example, a combined coal/oil burner. Coaxially with and enclosing the coal/oil burner one or more pipes are provided for supplying air to the burner tip, which air supply pipes are enclosed by a substantially tubular register casing having openings that permit combustion air from the windbox to flow into one or more of the air supply pipes. The air flow through the openings in the register casing is controlled by means of an axially displaceable ring damper.

In many known windbox burners the sealing means at the ends of the air damper are usually only the roughly machined ends of the tubular ring damper abutting corresponding flanges in the register casing or a stop mounted thereon. Such a known ring damper may have a diameter of about 2 m, and owing to the tolerances used, a large leakage loss occurs both in the closed position of the ring damper and in its partially open position, resulting in an inadequate control of the air supply, which again may give rise to poor combustion with a consequent high NOX figure and adversely affecting the environment.

In GB-A-1 527 072 and, in particular, FR-A-1 561 182, improved tightness has been achieved by the use of sealing means of a stainless and heat-resistant material, of which one sealing means comprises at least one plane leaf spring.

As controlling the air flow in such burners is essential in order to create combustion conditions under which the formation of nitrogen oxides is as low as possible, several other attempts have been made to reduce the formation of NOX.

In GB patent application No. 2 146 112 the quantity of combustion air through two secondary air passages is controlled by axial displacement of a ring damper in the form of a sleeve, the swirl in each passageway being regulated by swirl vanes.

U.S. Pat. No. 3,904,349 discloses a burning apparatus in which the combustion air supplied from the windbox is distributed among three separate passageways. The quantity admitted to each passageway is controlled by separate flow regulating means.

The object of the invention is to improve a windbox burner of the type mentioned in the introduction, in which the combustion conditions in the burner are optimized with respect to maximum reduction of the formation of NOX.

This is achieved according to the invention in that the secondary air pipe supports an axially adjustable tubular damper adapted to overlapping at least a portion of each of the inlet ports and having an external collar, that in one open position the ring damper overlaps the external collar, whereby the flow of air through the space between the secondary air pipe and the register casing is substantially blocked by the external collar, and that in a second, more open position the ring damper is free of the external collar, whereby air is permitted to flow through said space as tertiary air.

By this design it is possible to divide the flow of combustion air flowing through the openings in the register casing into a secondary air flow being passed to the secondary air pipe already when the ring damper begins opening, and into a tertiary air flow formed at a later time by the opening of the ring damper. The tertiary air flow is passed to the burner tip through the space or annular channel defined between the secondary air pipe and the register casing. The axially adjustable tubular damper can, for example, be adjusted by means of a manually actuated screw rod or a pneumatic working cylinder receiving control impulses from the control system of the boiler or the furnace.

It is thus possible to maintain favourable combustion conditions even at partial or low-load operation as the quantity of tertiary air may be reduced and eventually eliminated when reducing the total quantity of air to the burner by movement of the ring damper.

In an embodiment of the windbox burner according to the invention, the leaf spring of one sealing means has radial slits arranged equidistantly along the periphery to increase the flexibility of the leaf spring. The increased flexibility of the leaf spring thus obtained means that the seal can compensate for larger deviations in shape and inaccuracies in the manufacture of the ring damper and the corresponding parts of the register casing.

In another embodiment one sealing means may comprise a second leaf spring abutting the first leaf spring and being substantially formed in the same way as the first leaf spring, and the slits in the two leaf springs may be mutually displaced in the tangential direction to prevent air from flowing through the slits.

Use of two leaf springs with mutually displaced slits prevents any leakage loss that might occur through the slits of the individual leaf spring.

In further embodiments the leaf spring may be made of stainless spring band steel, and the corresponding sealing means may be a ring made of stainless round bar steel.

To ensure accurate guidance of the ring damper in relation to the register casing and thus an accurate mutual location of the sealing means at closure of the ring damper, and to ensure that the often very heavy ring damper is easily mobile in the axial direction, the ring damper in embodiments of the windbox according to the invention may be mounted on a carriage adapted to slide on rails mounted in parallel with the centre axis of the windbox burner, or the ring damper may be mounted on a trolley with wheels adapted to run on said rails.

To further ensure that the ring damper can compensate for any inaccuracies in the alignment of the individual parts of the register casing, the ring damper may be pivotable about an axis being substantially perpendicular to the centre axis of the windbox burner and intersecting it. It is also possible in one embodiment to let the ring damper be resiliently supported on the carriage or the trolley, which again causes the ring damper in the closed position to be able to compensate for any inaccuracies.

In one embodiment, the carriage or the trolley may support a fitting formed as a half-ring having at each end a pivot pin on which the ring damper is pivotably journalled, and there may be stops to limit the swinging movement of the ring damper to a swing of about ±2.5° in relation to the centre axis of the windbox burner.

It has been found that letting the ring damper be biased to assuming one of its extreme positions in the swing direction when in the open position provides an especially good seal when the ring damper is moved to its closed position. It is not quite clear why this effect is obtained, but it is presumed that since the sealing means of the ring damper are moved against each other not only in the axial direction of the ring damper, but also in a direction perpendicular thereto, this may cause better abutment and thus improved tightness. It is also possible that the movement transversely to the longitudinal direction may contribute to removing any collections of impurities on the sealing means and thus contribute to improved tightness. The force moving the ring damper towards its one extreme position in the swing direction may be obtained, for example, by weight-loading one end of the ring damper, by displacing the pivot pins in relation to the middle of the ring damper, or by biasing the ring damper by an elastic force.

In a further embodiment of the invention, the ring damper is arranged inside the register casing. This has been found to entail considerable advantages, especially during dispatch and installation of windbox burners in the windbox of the boiler or furnace. Letting the ring damper be enclosed by the register casing leaves the movable parts, such as the trolley or the carriage and the ring damper itself, protected against any damage that may occur during dispatch or at the installation. If the ring damper is arranged to enclose the outside of the register casing, the ring damper with trolley or carriage must be secured so as not to move during transportation, and likewise the risk of damage to the ring damper is great, for example if the whole windbox burner is lifted in straps placed around the ring damper.

The ports of the register casing may be formed so that the flow area in the first part of the opening movement of the ring damper increases progressively, while the flow area in the subsequent part of the movement of the ring damper increases proportionally with the axial displacement. This renders it possible to achieve a more even adjustment of the air flow over the full opening stretch of the ring damper.

BRIEF DESCRIPTION OF THE DRAWINGS

As shown in FIG. 1, the windbox burner is fitted into a windbox 1 and has a tubular register casing 2 with ports 3 arranged along the periphery for an inward flow of combustion air from the windbox. As shown in FIG. 8, the width of the port 3 measured along the periphery of the register casing is relatively small at the end furthest away from the burner tip, while the width increases towards the burner tip. At one end the register casing is closed by means of a bolted on front plate 5. Inside the register casing and coaxially therewith is a secondary air pipe 35 having openings 36 for secondary air. The secondary air pipe 35 is closed at one end by means of a bolted on plate.

Figure 1:
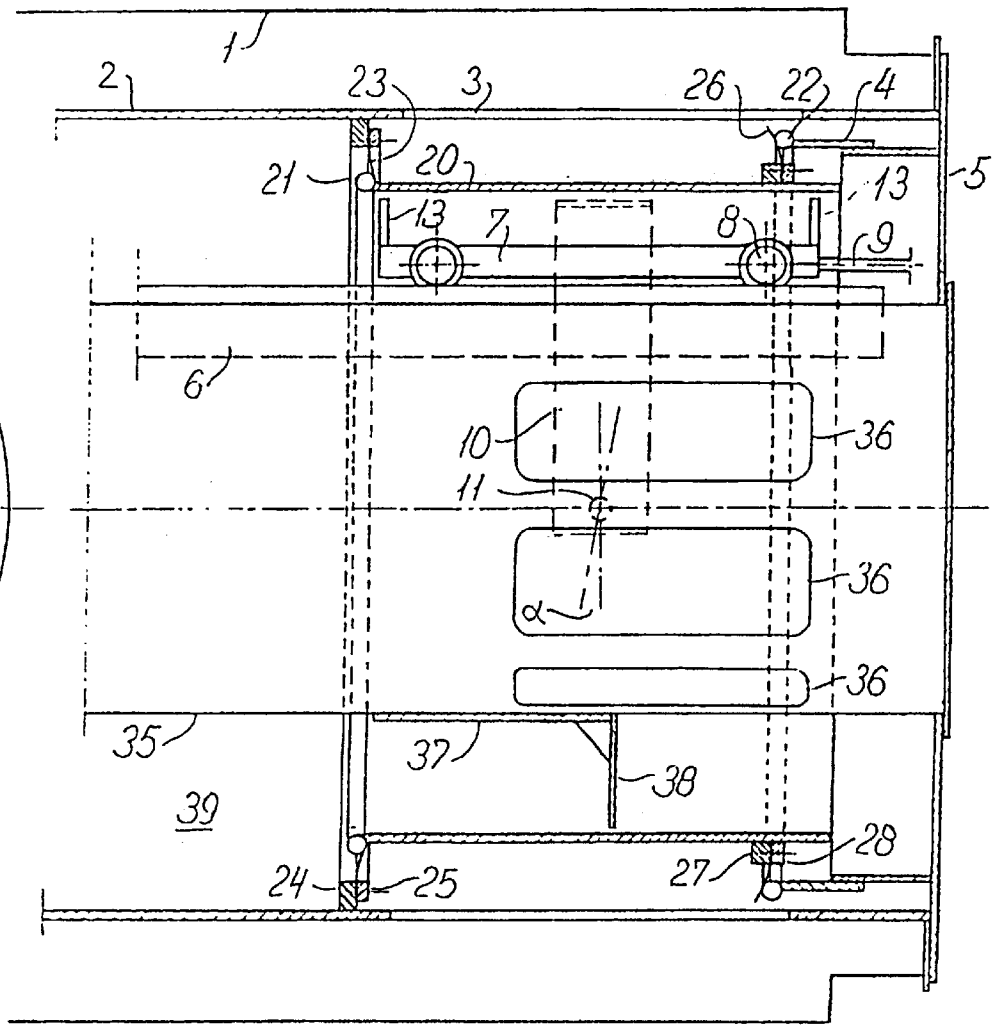
FIG. 1 is a partially cross-sectional, schematic side view of part of a windbox burner according to the invention with a ring damper shown in a closed position.
Figure 2:
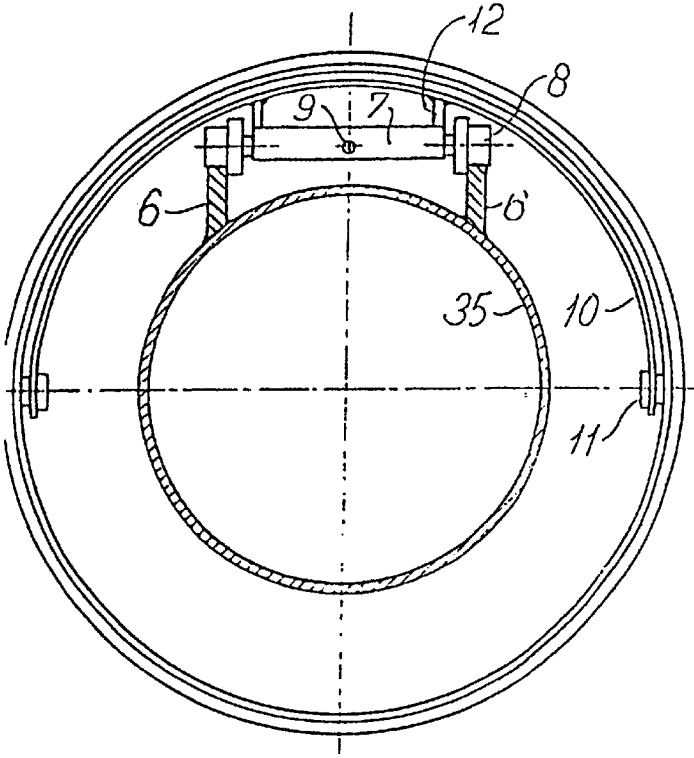
FIG. 2 shows a cross-sectional end view of the ring damper of the windbox burner with a secondary air pipe.

A tubular ring damper 20 enclosing the secondary air pipe 35 is supported on a trolley 7 with wheels 8 running on two mutually parallel rails 6 welded on to the secondary air pipe. By means of a pull rod 9 connected with, for instance, a compressed-air cylinder, the trolley 7 can be reciprocated along the secondary air pipe. The ring damper 20 is suspended in the trolley 7 by means of a semicircular bracket 10 which is welded at the middle to the trolley by means of lugs 12 and journalled swingably about pivot pins 11 welded to the inner surface of the cylindrical wall of the ring damper. As indicated in FIG. 1, the ring damper can swing through an angle $\alpha$ to either side of a starting position in which the longitudinal axis of the ring damper coincides with the centre axis of the windbox burner. The swings of the ring damper are limited by two stops 13 arranged on the trolley 7.

Figure 7:
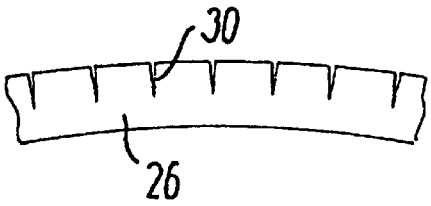
FIG. 7 is a part view of a leaf spring.
Figure 8:
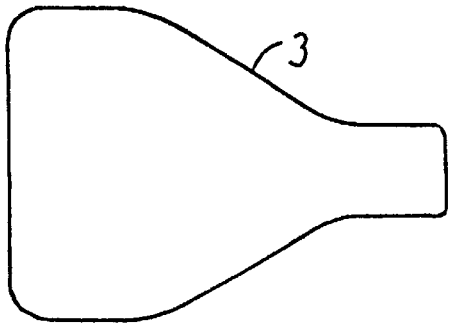
FIG. 8 is a plane view of a port in the register casing of the windbox burner for supply of secondary and tertiary air.

At one end the ring damper has a welded-on ring 21 of stainless round bar steel which, as shown in FIG. 1, abuts an annular leaf spring 23 which is retained by means of a retaining ring 25 against a flange 24 welded into the register casing 2. At the other end of the ring damper is a similar annular leaf spring 26 made of stainless spring band steel which by means of a holding ring 28 is clamped on to a flange 27 welded on to the ring damper. In the closing position, the leaf spring 26 abuts a ring 22 of stainless round bar steel welded on to a stop 4, which is against fixedly connected with the front plate 5 on the register casing. As it appears from FIG. 1 it is possible by removal of the front plate 5 to take out the ring damper 20 with trolley 7 for overhauling or replacement, and there is also access for a possible removal of the leaf spring 23. As shown in FIG. 7, the leaf spring has radial slits 30 along its outer periphery.

About the secondary air pipe 35 is arranged a tubular damper 37, which is longitudinally adjustable and has a collar 38 of an outer diameter so that the collar substantially blocks the space between the outer surface of the secondary air pipe 35 and the inner surface of the ring damper 20. For the sake of clarity, the tubular damper 37 and the collar 38 are shown only in the lower half of FIGS. 1, 3 and 4. It is not shown in detail how the tubular damper is adjusted axially, but this may be done, for instance, by means of a manually operated screw rod mounted in the removable front plate 5.

Figure 3:
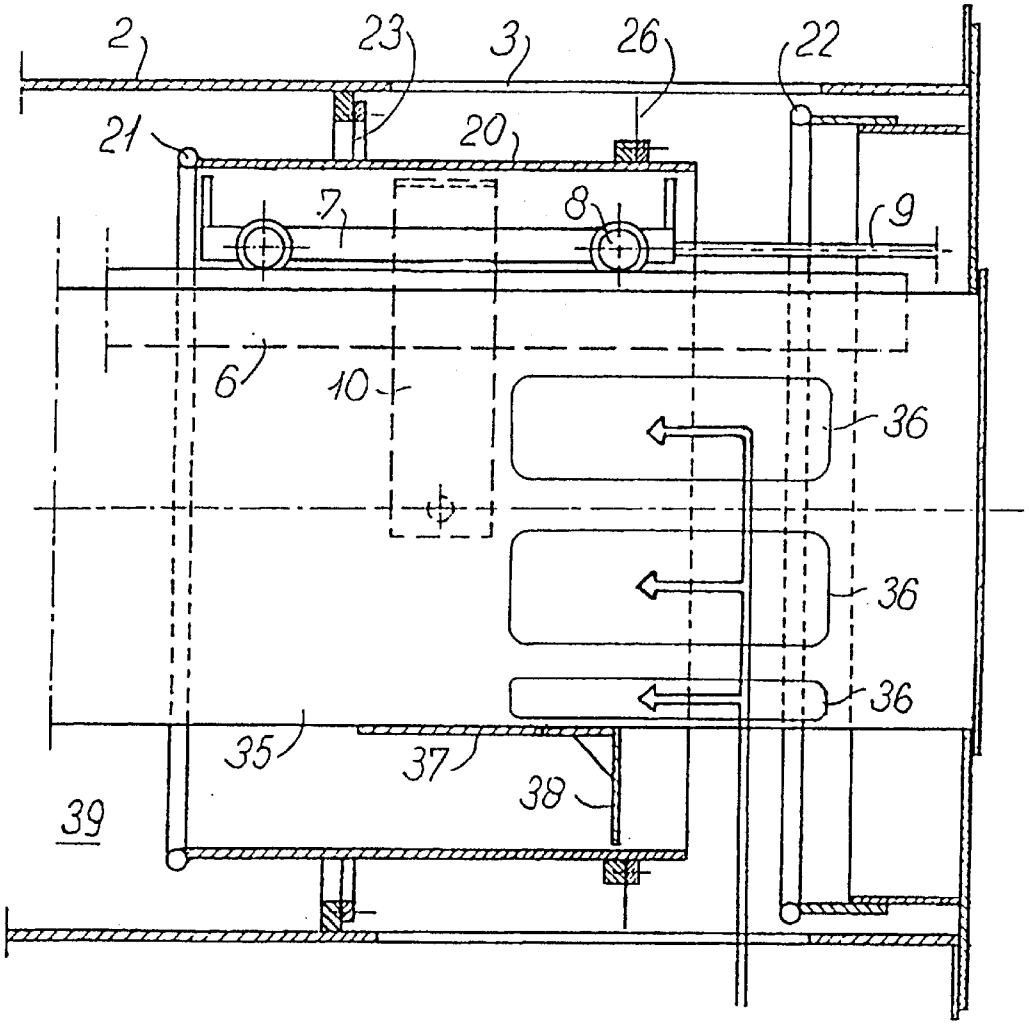
FIG. 3 is a view like that shown in FIG. 1 with the ring damper shown in a partially open position.

The ring damper in the windbox burner according to the invention operates in the following manner: In the closed position of the ring damper, as illustrated in FIG. 1, the ring 21 at one end of the ring damper abuts the leaf spring 23, and at the same time the leaf spring 26 at the other end of the ring damper abuts the ring 22 on the stop 4. Because of the flexibility of the leaf springs good sealing is ensured between the respective sealing means, and any inaccuracies are compensated for by the ring damper having the possibility to tilt about its axis through the pivot pins 11. The combustion air supplied to the windbox 1 in a manner not shown, is thus prevented from flowing through the openings 3 in the register casing and on to the burner tip. When the opening of the ring damper is commenced, as illustrated in FIG. 3, the air can flow through the openings 3 in the register casing 2 as shown by the arrows indicated and on through the air openings 36 in the secondary air pipe 35. On the other hand any air passage through the ring damper is blocked by the collar 38, and the passage around the ring damper is blocked by the leaf spring 26. At the same time the tubular damper 37 by its overlapping of the ports 36 prevents secondary air from flowing from the secondary air pipe 35 into the ring damper to the space 39 for tertiary air.

Figure 4:
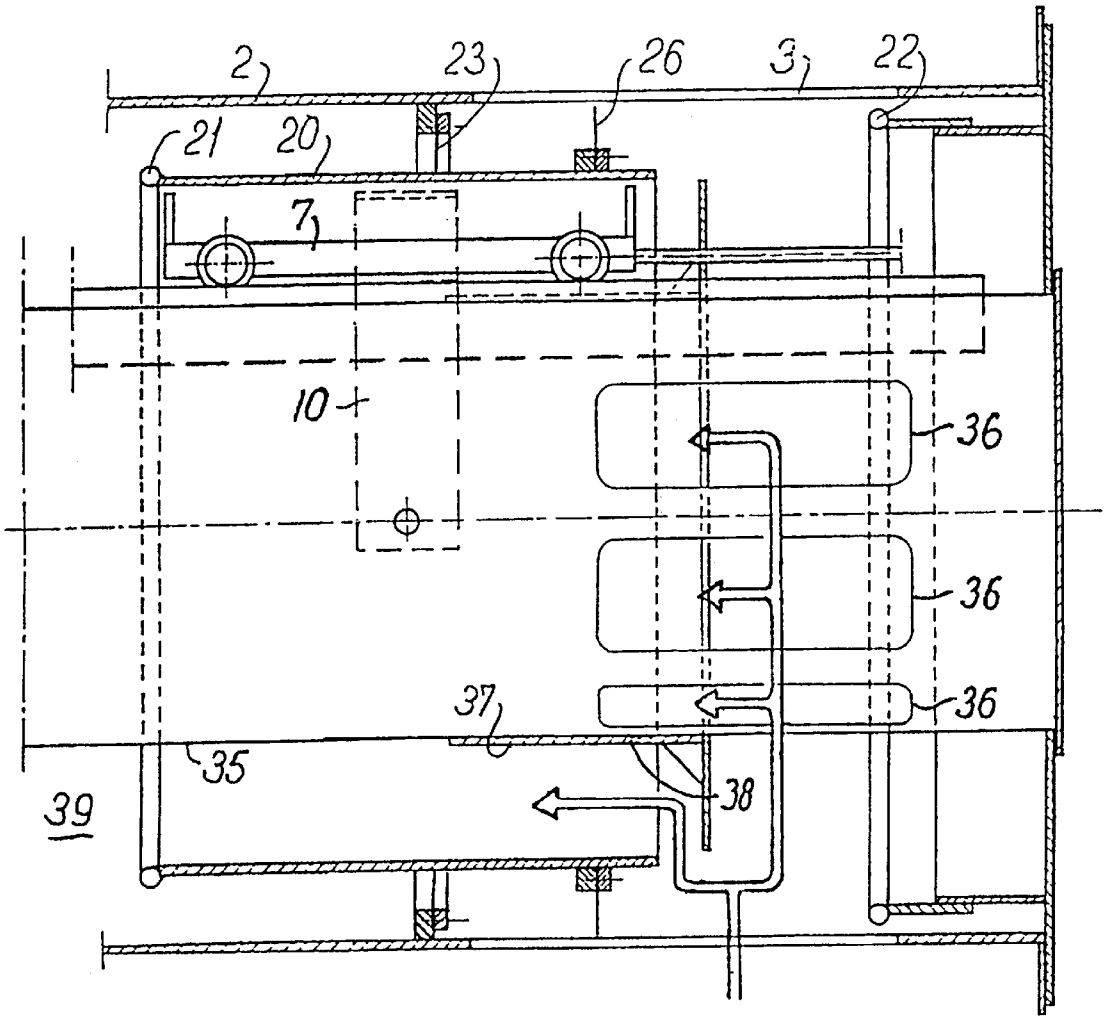
FIG. 4 is a view as that seen in FIG. 3 with the ring damper shown in a more open position.

When the ring damper opening is increased, as illustrated in FIG. 4, it can be seen that the combustion air in the windbox 1 can still flow through the ports 3 in the register casing 2 and on into the secondary air pipe 35 through the ports 36 therein. However, since the ring damper now no longer overlaps the collar 38, the combustion air which has flowed in through the ports 3 can now also continue through the ring damper into the space 39 for tertiary air. Since the tubular damper 37 with the collar 38 is axially adjustable, it is thus possible to adjust the time of opening of the passage for tertiary air through the ring damper.

Figure 5:
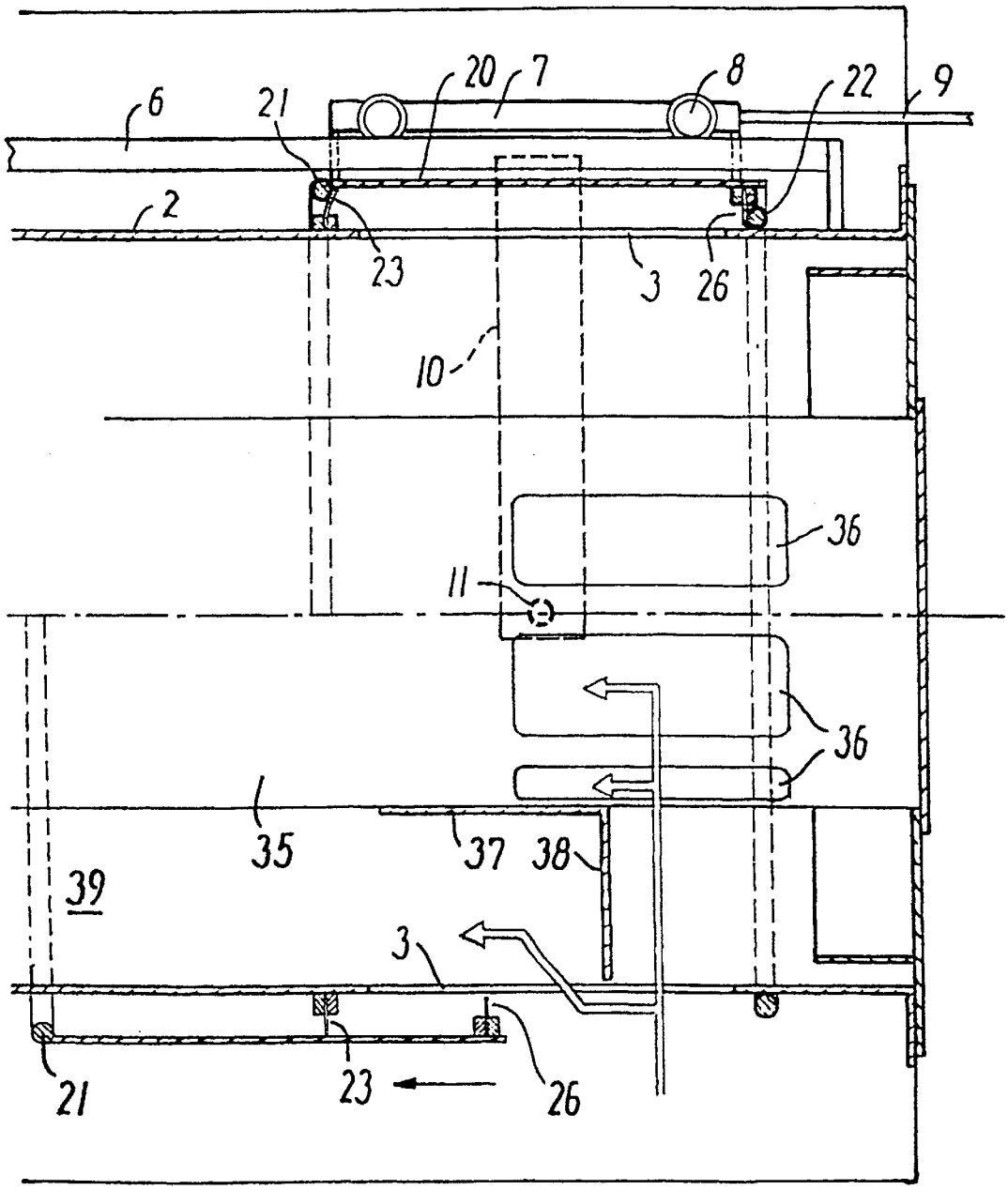
FIG. 5 is a partially cross-sectional, schematic side view of a windbox burner in which the ring damper encloses the register casing.
Figure 6:
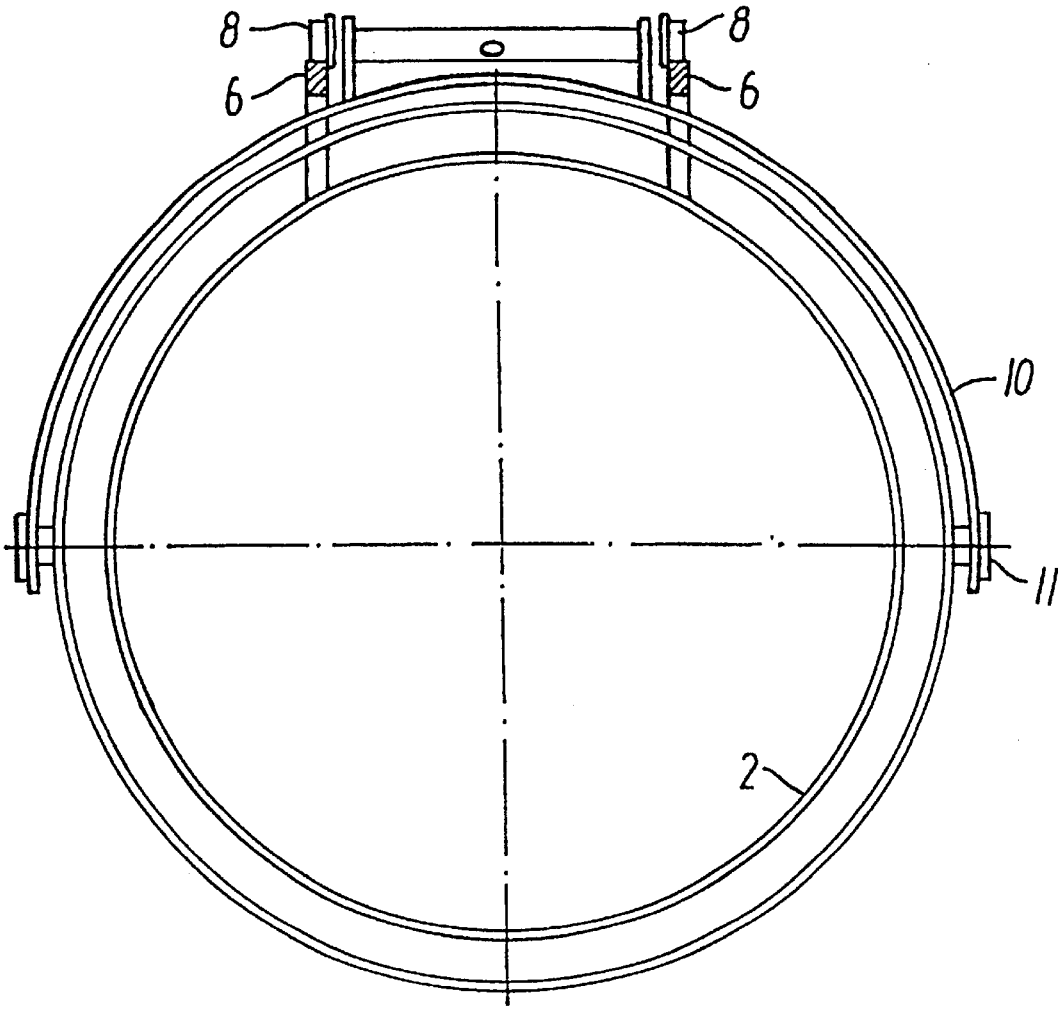
FIG. 6 is a schematic end view of the ring damper of the windbox burner of FIG. 5.

As shown in FIGS. 5 and 6, the windbox burner can also be designed so that the ring damper 20 encloses the register casing 2. As shown in the upper part of the Figure, the trolley can run on rails 6 mounted on the upper surface of a secondary air pipe 35. Also in the upper part of the Figure, the ring damper is shown in a closed position in which flow of combustion air from the windbox through the ports 3 in the register casing 2 is blocked. In the lower part of the Figure, the ring damper 20 is shown in an open position in which it does not overlap the outward collar 38 on the tubular damper 37 so that as indicated by arrows both secondary air and tertiary air flows into the burner. For the sake of clarity, the tubular damper 37 with the collar 38 is only shown in the lower part of the Figure.

What is claimed is:

1. A windbox burner comprising a register casing (2) with ports (3) for inflow of combustion air, a secondary air pipe (35) coaxial with the register casing and enclosed by the register casing and having inlet ports (36) for secondary air, and a ring damper (20) substantially coaxial with the register casing and extending axially between two first annular sealing means, one of said first annular sealing means being located adjacent to each axial end of the ports of the register casing, said ring damper being axially displaceable and having at each end a second annular sealing means (21;26) which, in the closed position of the ring damper, sealingly abuts a corresponding one of said first annular sealing means (22;23), thereby preventing the combustion air from flowing through the ports of the register casing (3) to the burner tip, said first and second sealing means (21,23;22,26) being made of a stainless and heat-resistant material, and at least one of the first and second sealing means comprising at least one plane leaf spring (23;26) the plane of which is substantially perpendicular to the longitudinal axis of the ring damper (20), wherein the secondary air pipe (35) supports an axially adjustable tubular damper (37) adapted to overlap at least a portion of each of the inlet ports (36) of the secondary air pipe, said tubular damper having an external collar (38) extending, in a first open position of the ring damper, at least most of the distance from the tubular damper to the register casing and substantially closing off an annular passageway between the secondary air pipe and the register casing so that in said first open position, the flow of air through the space between the secondary air pipe and the register casing is substantially blocked by the external collar, and in a second, more open position, the external collar is axially spaced from the ring damper so that an axial opening is present between the ring damper and the external collar, whereby air is permitted to flow through said opening as tertiary air.

2. A windbox burner according to claim 1, characterized in that the leaf spring (23;26) of one sealing means has radial slits (30) arranged equidistantly along the periphery of the leaf spring to increase the flexibility of the leaf spring.

3. A windbox burner according to claim 2, characterized in that one sealing means comprises a second leaf spring abutting the first leaf spring (23;26) and being substantially formed in the same way as the first leaf spring, and that the slits (30) in the two leaf springs are mutually displaced in the tangential direction to prevent air from flowing through the slits.

4. A windbox burner according to claims 2, characterized in that the leaf spring (23;26) is made of stainless spring band steel.

5. A windbox burner according to claim 1 preceding claims, characterized in that the corresponding sealing means is a ring (21;22) made of stainless round bar steel.

6. A windbox burner according to claim 1 preceding claims, characterized in that the ring damper (20) is mounted on a carriage adapted to slide on rails (6) mounted in parallel with the centre axis of the windbox burner.

7. A windbox burner according to claims 1, characterized in that the ring damper (20) is mounted on a trolley (7) with wheels (8) adapted to run on rails (6) mounted in parallel with the center axis of the windbox burner.

8. A windbox burner according to claim 6, characterized in that the ring damper (20) is pivotable about an axis being substantially perpendicular to the center axis of the windbox burner and intersecting center axis.

9. A windbox burner according to claim 8, characterized in that the ring damper (20) is resiliently supported on the carriage (7).

10. A windbox burner according to claim 8, characterized in that the carriage (7) supports a semicircular bracket (10) having at each end a pivot pin (11) on which the ring damper (20) is pivotably journalled.

11. A windbox burner according to claim 8, characterized in that there is a stop (13) to limit the pivoting movement of the ring damper (20) to a deflection of about ±2.5° in relation to the center axis of the windbox burner.

12. A windbox burner according to claim 1, characterized in that the ring damper (20) is arranged inside the register casing (2).

13. A windbox burner according to claim 7, characterized in that the ring damper (20) is pivotable about an axis being substantially perpendicular to the center axis of the windbox burner and intersecting the center axis.

14. A windbox burner according to claim 13, characterized in that the ring damper (20) is resiliently supported on the trolley (7).

15. A windbox burner according to claim 13, characterized in that the trolley supports a semicircular bracket (10) having at each end a pivot pin on which the ring damper (20) is pivotably journalied.

* * * * *